US007349662B2

(12) United States Patent
Nanjo

(10) Patent No.: US 7,349,662 B2
(45) Date of Patent: Mar. 25, 2008

(54) FIXING DEVICE AND IMAGE FORMING APPARATUS

(75) Inventor: Yuzuru Nanjo, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 11/375,978

(22) Filed: Mar. 15, 2006

(65) Prior Publication Data

US 2006/0213902 A1 Sep. 28, 2006

(30) Foreign Application Priority Data

Mar. 23, 2005 (JP) ..... 2005-084061

(51) Int. Cl.
*G03G 15/20* (2006.01)

(52) U.S. Cl. ..... 399/328; 399/334; 219/619

(58) Field of Classification Search ..... 399/328, 399/334; 219/619
See application file for complete search history.

(56) References Cited

U.S. PATENT DOCUMENTS 6,605,802 B2 * 8/2003 Nagahira ..... 219/619
7,158,748 B2 * 1/2007 Kwak et al. ..... 399/330
2002/0020699 A1 * 2/2002 Nagahira ..... 219/619
2004/0105708 A1 * 6/2004 Imai et al. ..... 399/330

FOREIGN PATENT DOCUMENTS

JP 2004-151470 5/2004

* cited by examiner

*Primary Examiner*—Quana M Grainger
*Assistant Examiner*—Bryan Ready
(74) *Attorney, Agent, or Firm*—Gerald E. Hespos; Anthony J. Casella

(57) ABSTRACT

An image forming unit of a copier is provided with an image fixing unit (fixing device) adopting an induction heating method. A heating roller of this image fixing unit includes a heat producing layer made of a temperature-sensitive magnetic material whose permeability changes with temperature, and a supporting layer disposed adjacent to the heat producing layer and made of a nonmagnetic and electrically conductive material. The heat producing layer has a width substantially equal to a passing area (about 294 mm) for sheets along a direction of an axis of rotation of the heating roller and smaller than a width (about 310 mm) of an induction heating coil.

20 Claims, 5 Drawing Sheets

FIXING DEVICE AND IMAGE FORMING APPARATUS

BACKGROUND OF THE INVENTION

1. Field of the Invention

The present invention relates to an image forming apparatus such as a copier and a fixing device provided in the image forming apparatus and, particularly to a fixing device for fixing a toner image to a sheet using a heating roller heated by an induction heating method and an image forming apparatus using such a fixing device.

2. Description of the Related Art

In recent years, the use of power-saving fixing devices of the induction heating type has been widely spread due to a reduction in the heat capacities of heating rollers and an improvement in the heating efficiency of heating rollers. In the conventional fixing devices of the induction heating type, it is designed to thin a heating roller as the heat capacity of the heating roller is reduced. However, such thinning of the heating roller reduces an amount of heat transfer of the heating roller in longitudinal direction and, resulting from the improvement in the heating efficiency, the influence of detection lags (delays) of a temperature detecting thermistor and a thermostat in response to a temperature increasing rate of the heating roller increases. This has caused a problem that the temperature of the heating roller partially excessively increases to cause an error in the image fixing operation such as a hot offset.

In order to solve the above problem, various technologies using heating rollers including a temperature-sensitive magnetic metal layer and a nonmagnetic metal layer have been proposed, for example, in Japanese Unexamined Patent Publication No. 2004-151470 (hereinafter, "document D1"). In an induction heating fixing device disclosed in the document D1, an increase in the temperature of the heating roller above a preset Curie temperature of the temperature-sensitive magnetic metal layer is suppressed by regulating the thickness of the temperature-sensitive magnetic metal layer of the heating roller to a specified range.

FIG. 4 is a section showing the construction of a conventional fixing device. With reference to FIG. 4, a conventional fixing device 247 of the induction heating type as disclosed in the above document D1 is provided with a tubular heating roller 247*a* that produces heat by an induction heating method, a pressure roller 247*b* disposed in such a manner that can be pressed into contact with the heating roller 247*a*, and an induction heating coil 247*c* for increasing the temperature of the heating roller 247*a*, wherein a toner image on the front face of a sheet passing a contact portion between the heating roller 247*a* and the pressure roller 247*b* is fixed to the sheet by the heat produced by the heating roller 247*a*. The heating roller 247*a* has a double-layer structure comprised of a temperature-sensitive magnetic metal layer 247*d* having a width substantially constant along a direction of an axis of rotation of the heating roller 247*a* and a nonmagnetic metal layer 247*e* provided on the outer side of the temperature-sensitive magnetic metal layer 247*d*. The heating roller 247*a* has the opposite ends thereof rotatably supported by bearings 247*f*, and a drive gear 247*g* is mounted at one end of the heating roller 247*a*. Thus, width L11 of the heating roller 11 is at least larger than a sheet passing area L12 by as much as a sum of areas where the heating roller 247*a* are in contact with the bearings 247*f* and an area where the drive gear 247*g* is mounted.

The induction heating coil 247*c* is disposed in the heating roller 247*a*. Since it is sufficient for this induction heating coil 247*c* to be capable of at least heating a part of the heating roller 247*a* corresponding to the sheet passing area L12, width L13 of the induction heating coil 247*c* is slightly larger than the sheet passing area L12 as shown in FIG. 4. Thus, in the conventional fixing device 247 of the induction heating type as shown in FIG. 4, the width L11 of the heating roller 247*a* is larger than the sheet passing area L12 and the width L13 of the induction heating coil 247*c*.

In the conventional fixing device 247 of the induction heating type as disclosed in the document D1, the width L11 of the heating roller 247*a* including the temperature-sensitive magnetic metal layer 247*d* is larger than the width L13 of the induction heating coil 247*c*. Thus, if the temperature of the heating roller 247*a* is equal to or below the Curie temperature of the temperature-sensitive magnetic metal layer 247*d*, magnetic fields produced by the induction heating coil 247*c* are pulled by the temperature-sensitive magnetic metal layer 247*d* as shown in FIG. 5, thereby diffusing outward. Accordingly, the magnetic fields supplied to portions of the heating roller 247*a* corresponding to the vicinities of the opposite ends of the sheet passing area L12 weaken, wherefore there is a problem of being difficult to increase the temperatures of the portions of the heating roller 247*a* corresponding to the vicinities of the opposite ends of the sheet passing area L12. This results in a problem that the toner image is insufficiently fixed at the opposite ends of the sheet having the width L12 during a warm-up period.

In the conventional fixing device 247 of the induction heating type as disclosed in the above document D1, it can be thought to suppress a temperature decrease at the portions of the heating roller 247*a* corresponding to the vicinities of the opposite ends of the sheet passing area L12 by increasing an amount of a ferrite core at portions of the heating roller 247*a* corresponding to the opposite ends of the sheet passing area L12 or increasing the number of turns of the coil at these portions. However, in such a case, a new problem of enlarging the parts due to an increase in the used amount of the ferrite core or the coil is created and, in addition, the warm-up period becomes longer and the toner image is likely to be insufficiently fixed at the central side of the sheet passing area since the magnetic fields weaken at the central side of the sheet passing area as the magnetic fields strengthen at the opposite ends of the sheet passing area.

SUMMARY OF THE INVENTION

In view of the above problems, an object of the present invention to provide a fixing device capable of shortening a warm-up period without enlarging parts and suppressing insufficient fixing and an image forming apparatus using such a fixing device.

In order to accomplish the above object, the invention is directed to a fixing device, comprising a heating roller for producing heat by an induction heating method; a pressure roller disposed in such a manner that can be pressed into contact with the heating roller; and an induction coil for increasing the temperature of the heating roller, a sheet having a toner image transferred thereto being passed through a contact portion between the heating roller and the pressure roller to have the toner image fixed thereto by the heat produced by the heating roller, wherein the heating roller includes a first layer made of a temperature-sensitive magnetic material whose permeability changes with temperature; and a second layer provided adjacent to the first layer and made of a nonmagnetic and electrically conductive material, the first layer having a width larger than a sheet passing area and smaller than the width of the induction coil along a direction of an axis of rotation of the heating roller.

The invention is also directed to an image forming apparatus, comprising a transferring unit for transferring a toner image to a sheet based on an image data, and an image fixing unit for fixing the toner image transferred to the front face of the sheet in the transferring unit to the sheet by heat, wherein the image fixing unit has the construction of the inventive fixing device.

In this way, by constructing the heating roller such that the width of the first layer made of the temperature-sensitive material is larger than the sheet passing area and smaller than the width of the induction coil, there can be suppressed the outward diffusion of magnetic fields produced by the induction coil by being pulled by the first layer made of the temperature-sensitive material when the temperature of the heating roller is equal to or below the Curie temperature of the temperature-sensitive material. This can suppress the weakening of the magnetic fields supplied to portions of the heating roller corresponding to the vicinities of the opposite ends of the sheet passing area.

This enables the temperatures of the portions of the heating roller corresponding to the vicinities of the opposite ends of the sheet passing area to be easily increased. Thus, a warm-up period of the device can be shortened without enlarging the parts, and insufficient fixing can be suppressed unlike a case where strong magnetic fields are produced at the portions of the heating roller corresponding to the vicinities of the opposite ends of the sheet passing area to suppress a temperature decrease at these portions by increasing an amount of a ferrite core at portions of the heating rollers corresponding to the opposite ends of the sheet passing area or increasing the number of turns of the induction coil at these portions.

These and other objects, features, aspects and advantages of the present invention will become more apparent upon a reading of the following detailed description and accompanying drawings.

DESCRIPTION OF THE PREFERRED EMBODIMENTS

Hereinafter, embodiments of the present invention are described with reference to the accompanying drawings.

Figure 1:
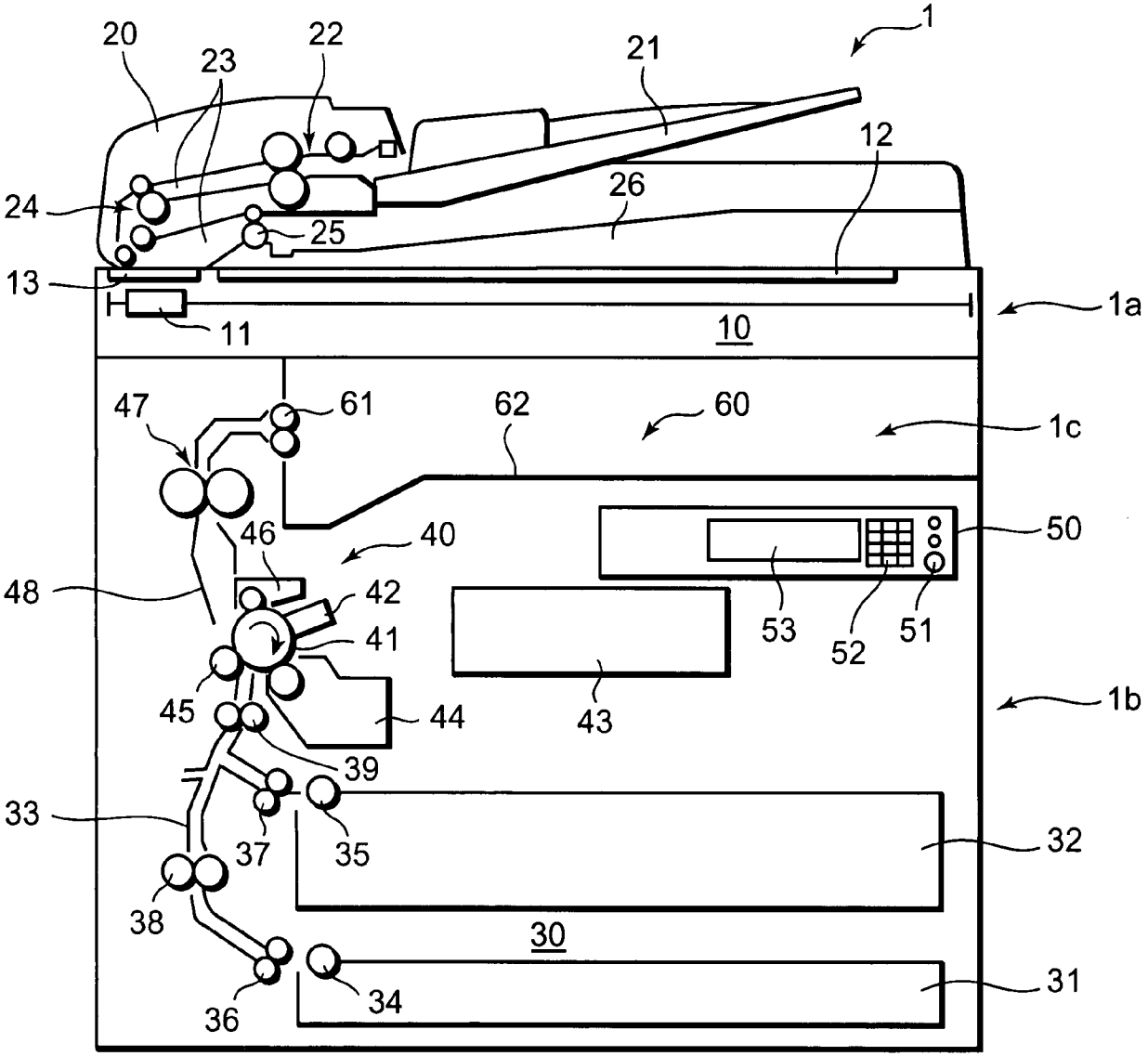
FIG. 1 is a front view showing the entire construction of a copier including an image fixing unit according to a first embodiment of the invention.
Figure 2:
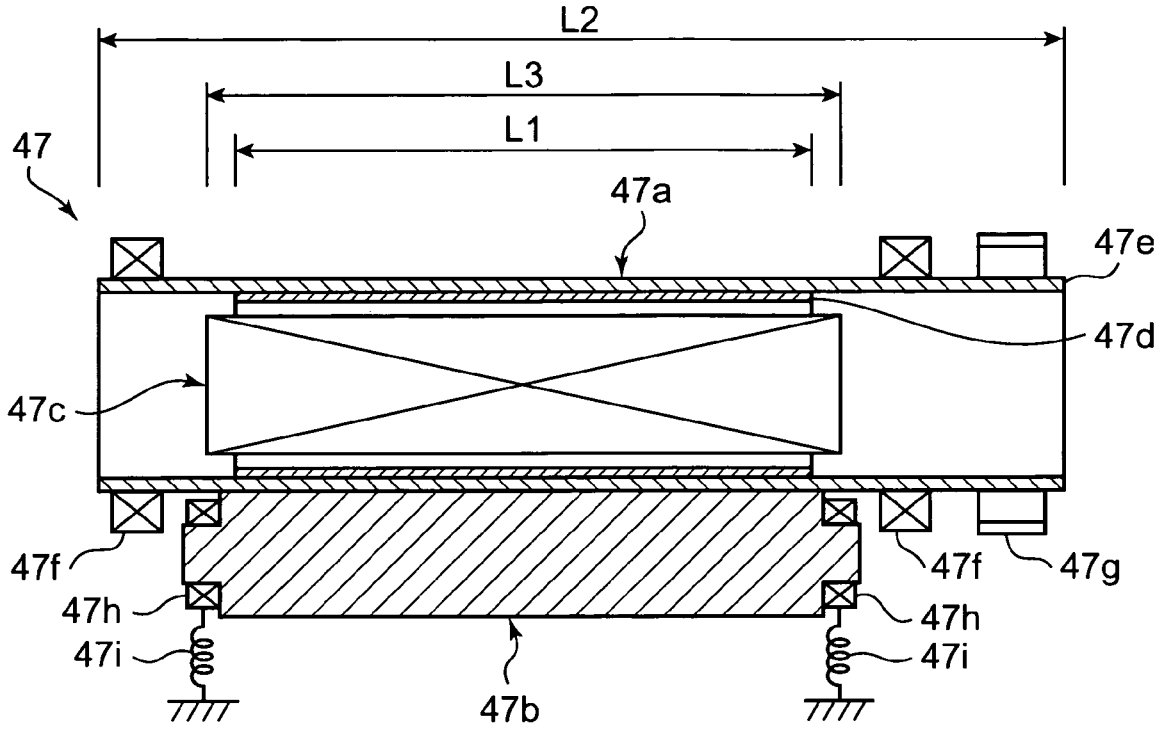
FIG. 2 is a section showing the construction of the image fixing unit of the first embodiment shown in FIG. 1.

FIG. 1 is a front view showing the entire construction of a copier 1 including an image fixing unit 47 according to a first embodiment of the invention, and FIG. 2 is a section showing the construction of the image fixing unit 47 of the copier 1 shown in FIG. 1. First, with reference to FIGS. 1 and 2, the entire construction of the copier 1 including the image fixing unit 47 according to the first embodiment is described. The image fixing unit 47 is one example of a "fixing device" according to the present invention.

As shown in FIG. 1, the copier 1 of the first embodiment is comprised of an upper housing 1*a* for reading a document image and a lower housing 1*b* disposed below the upper housing 1*a* for printing an image on a sheet (recording sheet). The copier 1 also has a room portion 1*c* between the upper and lower housings 1*a* and 1*b*, the room portion 1*c* horizontally extending inward (rearward) from a front-right side of the copier 1. In the copier 1 of this embodiment, an internal discharging unit 60 for stacking sheets discharged (internally discharged) from the lower housing 1*b* to be described later is provided in the room portion 1*c*.

The upper housing 1*a* includes a document reader 10 for reading a document image, and a document feeder 20 for feeding a document to the document reader 10.

The document reader 10 has a function of reading an image of a document fed by the document feeder 20 and generating an image data corresponding to the document image. The document reader 10 includes a scanner 11 provided with an exposure lamp and a CCD (charge coupled device) sensor for generating an image data from an optically obtained image of a document, a first contact glass 12 for reading a document placed on the upper surface of the scanner 11 and a second contact glass 13 for reading an automatically fed document. The document reader 10 is so constructed as to output information such as an image data obtained from a document placed on the first contact glass 12 or from a document fed to be held in contact with the second contact glass 13 by the document feeder 20 to an unillustrated controller.

The document feeder (ADF: automatic document feeder) 20 includes a document tray 21 on which documents are placed, a driving portion 22 for feeding a document from the document tray 21 by means of a feed roller or the like, conveyance rollers 24 for conveying the document along a conveyance path, discharge rollers 25 for discharging the document conveyed by the conveyance rollers 24, and a document discharge tray 25 onto which the document discharged by the discharge rollers 25 is placed (stacked). This document feeder 20 has a document reading function of the so-called sheet-through type for automatically feeding documents placed on the document tray 21 one by one while bringing the documents into contact with the second contact glass 13 and discharging the documents onto the document discharge tray 26 after exposure-scanning the documents in response to the entry to instruct the start of a copying operation.

The document feeder 20 is constructed to be rotatable about the rear side of the copier 1, thereby being openable and closable relative to the upper surface of the document reader 10. In the copier 1 of this embodiment, a document to be read such as an open book can be placed on the upper surface of the first contact glass 12 by lifting the document feeder 20 obliquely upward to the back side to expose the upper surface of the first contact glass 12.

The lower housing 1*b* is provided with a sheet feeding unit 30 for feeding sheets, an image forming unit 40 for printing the sheets, an operation/display unit 50 used to operate the copier 1, and the internal discharging unit 60 in which the printed sheets are discharged.

The sheet feeding unit 30 is adapted to feed sheets to the image forming unit 40. This sheet feeding unit 30 includes cassettes 31, 32 capable of accommodating sheets of the respective sizes (e.g. A3, A4, B4, B5, etc.), a conveyance path 33 for conveying sheets from the cassettes 31, 32 to the image forming unit 40, pickup rollers 34, 35 for picking up the sheets accommodated in the respective cassettes 31, 32, and feed rollers 36, 37 for feeding the sheets one by one to the conveyance path 33. The conveyance path 33 is provided with conveyance rollers 38 for conveying the sheet and registration rollers 39 for letting the conveyed sheet wait on standby before the image forming unit 40. The sheet feeding unit 30 may additionally include a manual feeding portion (not shown) such as a manual feeding tray constructed to be openable and closable relative to a side portion (e.g. right side portion) of the lower housing 1*b*. In such a case, a sheet conveyance path from the manual feeding portion preferably joins the conveyance path 33 at a side upstream of the registration rollers 39.

The image forming unit 40 has a function of forming (printing) a specified image on the sheet conveyed by the sheet feeding unit 30. This image forming unit 40 includes a photosensitive drum 41 supported to be rotatable in a direction of an arrow in FIG. 1, a charging device 42, a laser scanning unit 43, a developing device 44, a transfer roller 45, a cleaning device 46, and the image fixing unit 47. The elements 42 to 46 are arranged around the photosensitive drum 41, whereas the image fixing unit 47 is disposed downstream of the transfer roller 45. The image forming unit 40 is also provided with a sheet conveyance path 48 for conveying the sheet from the image forming unit 40 to the internal discharging unit 60.

The charging device 42 has a function of uniformly charging the outer surface of the photosensitive drum 41 at a specified potential. The laser scanning unit 43 emits a laser beam to the outer surface of the photosensitive drum 41 in accordance with an image data sent from an image storage (not shown) or the like, thereby forming an electrostatic latent image on the outer surface of the photosensitive drum 41. The developing device 44 has a function of developing the image (document image) by attaching toner to the electrostatic latent image on the outer surface of the photosensitive drum 41. The transfer roller 45 presses the sheet (recording sheet) conveyed from the sheet feeding unit 30 against the photosensitive drum 41 to transfer the toner image developed on the photosensitive drum 41 to the sheet. The cleaning device 46 is provided to clean off the toner residual on the outer surface of the photosensitive drum 41 after the image transfer to the sheet is completed.

Here, in the first embodiment, the image fixing unit 47 is, as shown in FIG. 2, provided with a tubular heating roller 47*a* that produces heat by an induction heating method, a cylindrical pressure roller 47*b* disposed in such a manner that can be pressed into contact with the heating roller 47*a*, and an induction heating coil 47*c* arranged in the heating roller 47*a* for increasing the temperature of the heating roller 47*a*. It should be noted that the induction heating coil 47*c* is one example of an "induction coil" according to the present invention. The image fixing unit 47 is so constructed as to be able to fuse the toner image on the front face of the sheet passing a contact portion between the heating roller 47*a* and the pressure roller 47*b* by the heat produced by the heating roller 47*a* and to fix the fused toner image to the sheet by pressure given by the pressure roller 47*b*.

The heating roller 47*a* has a double-layer structure comprised of a heat producing layer 47*d* made of a temperature-sensitive magnetic material (e.g. Fe—Ni alloy) whose permeability changes with temperature, and a supporting layer 47*e* disposed at the outer side and adjacent to the heat producing layer 47*d* and made of a nonmagnetic and electrically conductive material (e.g. aluminum). It should be noted that the heat producing layer 47*d* is one example of a "first layer" according to the present invention and the supporting layer 47*e* is one example of a "second layer" according to the present invention. The heat producing layer 47*d* is so disposed as to face the induction heating coil 47*c* arranged in the heating roller 47*a*. The heat producing layer 47*d* has a specified width L1 along a direction of an axis of rotation of the heating roller 47*a*, whereas the supporting layer 47*e* has a width L2 larger than the width L1 of the heat producing layer 47*d*. The width L1 of the heat producing layer 47*d* is set to be substantially equal to a passing area for sheets of the largest size used in the copier 1 (maximum sheet passing area). In the first embodiment, the width L1 is set at about 294 mm which is the passage area for A3 sheets. A heat producing layer having a thickness of 0.1 mm and made of a Fe—Ni alloy may, for example, be used as the heat producing layer 47*d* of the first embodiment.

The supporting layer 47*e* has a function of suppressing the continuation of the heat production of the heat producing layer 47*d* even at a temperature equal to or above a Curie temperature resulting from an increase of a load in response to an eddy current accompanying the thinning of the heat producing layer 47*d* made of the temperature-sensitive magnetic material having a high resistivity value. PFA (tetrafluoroethylene-perfluoroalkyl vinylether copolymer) is applied to the outer surface of the supporting layer 47*e*, thereby forming a release layer (not shown) having a function of letting the sheet easily part from the heating roller 47*a*. A supporting layer having an outer diameter of 40 mm, a thickness of 0.3 mm and made of aluminum may, for example, be used as the supporting layer 47*e* of the first embodiment.

Since the aforementioned heat producing layer 47*d* having a thickness of 0.1 mm and made of a Fe—Ni alloy functions to reinforce the heating roller 47*a* by being disposed in a middle part of the heating roller 47*a* with respect to longitudinal direction, the heating roller 47*a* can be sufficiently rotatably supported even if the supporting layer 47*e* having a relatively smaller thickness of 0.3 mm and made of aluminum is used. The heating roller 47*a* is rotatably supported by bearings 47*f* at the opposite ends of the supporting layer 47*e*, and a drive gear 47*g* for transmitting a torque from a drive motor (not shown) to the heating roller 47*a* is mounted at one end of the heating roller 47*a*.

The pressure roller 47*b* is made of a stainless steel fitted with an elastic foamed resin (not shown) such as a sponge, has the opposite ends thereof rotatably supported by bearings 47*h* and is biased toward the heating roller 47*a* by compression coil springs 47*i*.

The induction heating coil 47*c* causes the heat producing layer 47*d* of the heating roller 47*a* to create an eddy current by the supply of a high-frequency current from an unillustrated high-frequency power supply, thereby increasing the temperature of the heating roller 47*a*. Since it is sufficient for the induction heating coil 47*c* to be able to heat a portion of the heating roller 47*a* corresponding to at least the maximum sheet passing area L1 (about 294 mm), a width L3 of the induction heating coil 47*c* is set at about 310 mm in the first embodiment. Thus, the width L1 (about 294 mm) of the heat producing layer 47*d* of the heating roller 47*a* is smaller than the width L3 (about 310 mm) of the induction heating coil 47*c*.

Referring back to FIG. 1, the operation/display unit 50 is provided to enable a user (operator) to enter a specified instruction. This operation/display unit 50 includes a start key 51 used for the user to enter an instruction to start a copying operation, a numeric pad 52 used to enter the number of copies to be made and the like, and a display 53 such as a touch panel made of a liquid crystal display (LCD)

for displaying operation guide information used to enter the setting of the copying operation and displaying various operation buttons.

The internal discharging unit 60 includes discharge rollers 61 for discharging the sheet conveyed from the image forming unit 40 to the internal discharging unit 60 and a sheet discharge tray 62 onto which the discharged sheets are stacked.

In the first embodiment, by setting the width L1 of the heat producing layer 47*d* made of the temperature-sensitive magnetic material to be substantially equal to the maximum sheet passing area and smaller than the width L3 of the induction heating coil 47*c*, there can be suppressed the outward diffusion of magnetic fields generated by the induction heating coil 47*c* by being pulled by the heat producing layer 47*d* made of the temperature-sensitive magnetic material when the temperature of the heating roller 47*a* is equal to or below a Curie temperature of the temperature-sensitive magnetic material. Accordingly, the weakening of the magnetic fields supplied to the portions of the heating roller 47*a* corresponding to the vicinities of the opposite ends of the maximum sheet passing area L1 can be suppressed, which in turn enables the temperatures at these portions of the heating roller 47*a* to be easily increased. Thus, unlike a case where a temperature decrease at the portions of the heating roller 47*a* corresponding to the vicinities of the opposite ends of the maximum sheet passing area L1 is suppressed by generating stronger magnetic fields at these portions of the heating roller 47*a* by increasing the amount of a ferrite core at portions of the heating roller 47*a* corresponding to the opposite ends of the maximum sheet passing area L1 or increasing the number of turns at portions of the induction heating coil 47*c* corresponding to the opposite ends of the maximum sheet passing area L1, the warm-up period of the device can be shortened without enlarging the parts and insufficient fixing can be suppressed.

As described above, the width L1 of the heat producing layer 47*d* made of the temperature-sensitive magnetic material is substantially equal to the maximum sheet passing area L1 in the first embodiment. Thus, the heat producing layer 47*d* made of the temperature-sensitive magnetic material is not provided at portions of the heating roller 47*a* not corresponding to the maximum sheet passing area L1. This can suppress the heating of the portions of the heating roller 47*a* not corresponding to the maximum sheet passing area L1. Since the heating efficiency of the heating roller 47*a* can be more improved, the warm-up period of the device can be more shortened and insufficient fixing can be better suppressed.

In the first embodiment, the heating roller 47*a* is rotatably supported at the supporting layer 47*e* having the width L2 larger than the width L1 of the heat producing layer 47*d*. Thus, the heating roller 47*a* is rotatably supported at the supporting layer 47*e* while forming the heat producing layer 47*d* to have the width substantially equal to the maximum sheet passing area L1 and smaller than the width L3 of the induction heating coil 47*c*. Therefore, it is not necessary to separately provide a supporting member for rotatably supporting the heating roller 47*a*. This can suppress an increase in the number of parts.

Further, in the first embodiment, the heat producing layer 47*d* of the heating roller 47*a* is so disposed as to face the induction heating coil 47*c* arranged in the heating roller 47*a*. Thus, stronger magnetic fields can be supplied by the heat producing layer 47*d* made of the temperature-sensitive magnetic material as compared to a case where the supporting layer 47*e* made of the nonmagnetic and electrically conductive material is arranged between the heat producing layer 47*d* made of the temperature-sensitive magnetic material and the induction heating coil 47*c*. Therefore, the heating efficiency of the heating roller 47*a* can be more improved.

In addition, in the first embodiment, it is not necessary to separately provide a space for disposing the induction heating coil 47*c* outside the heating roller 47*a* by disposing the induction heating coil 47*c* in the tubular heating roller 47*a*. This can suppress the enlargement of the device.

Figure 3:
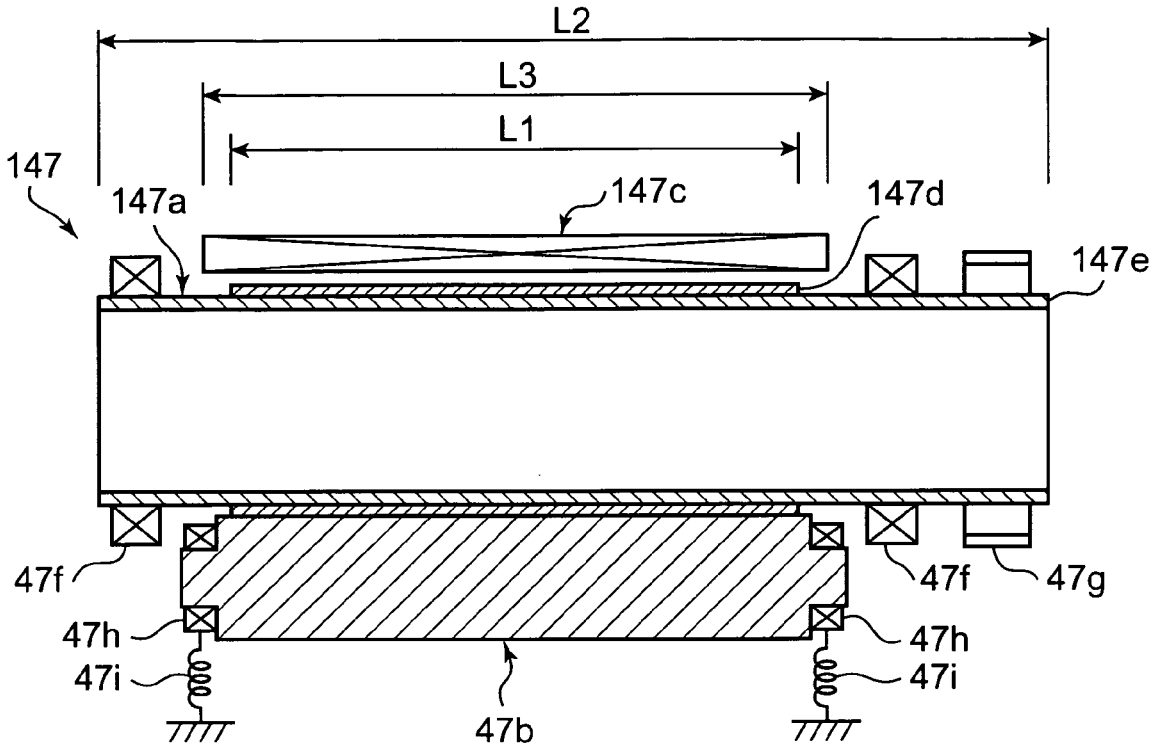
FIG. 3 is a section showing the construction of an image fixing unit according to a second embodiment of the invention.
Figure 4:
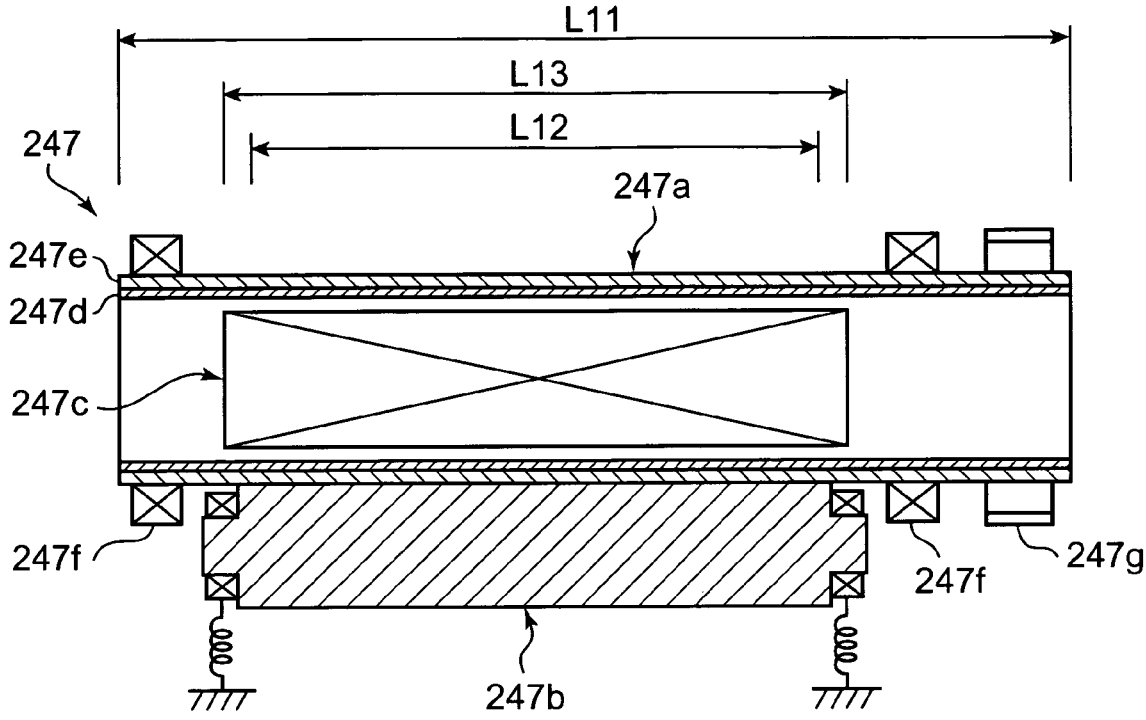
PRIOR ART FIG.4
FIG. 4 is a section showing the construction of a conventional fixing device.
Figure 5:
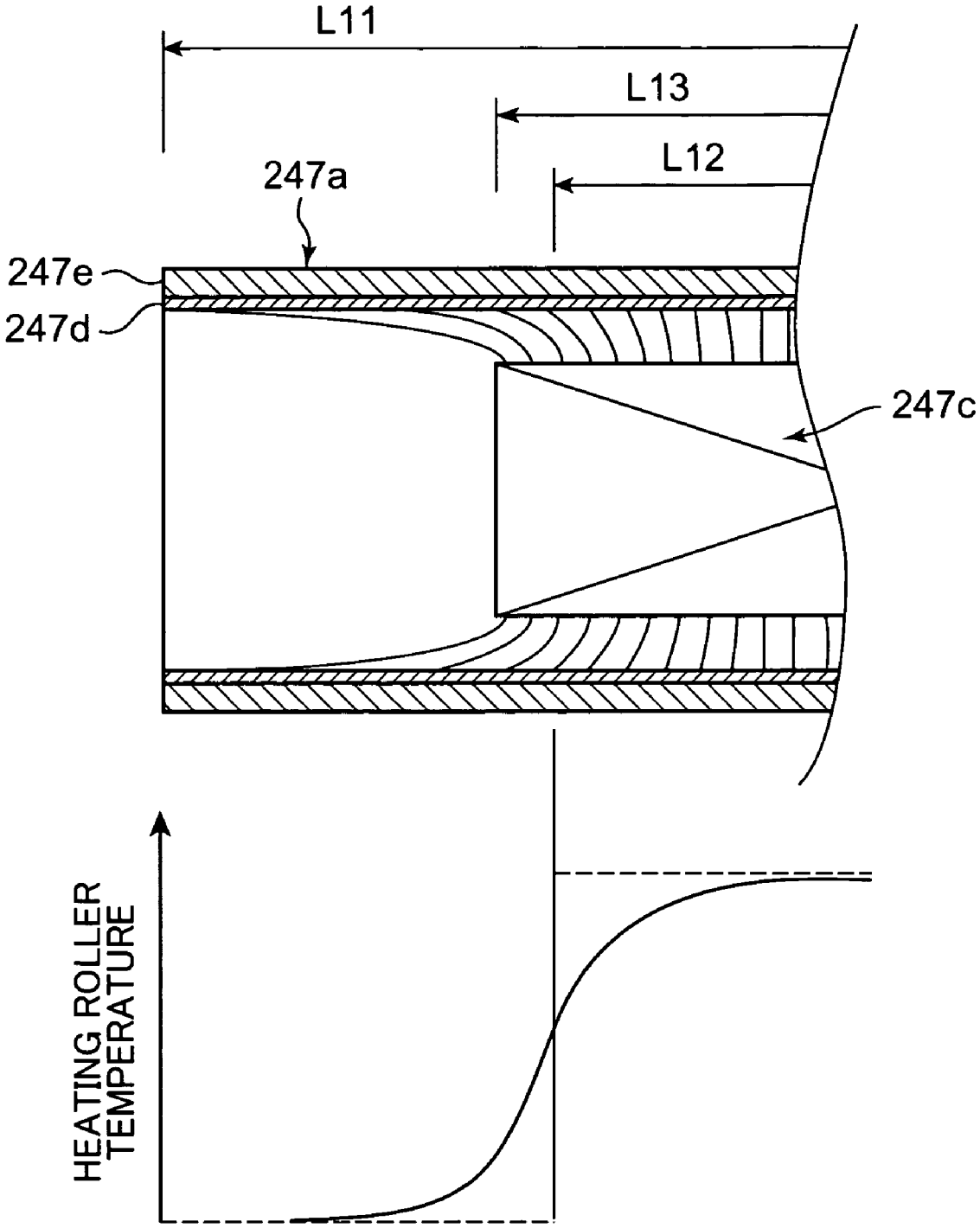
PRIOR ART FIG.5
FIG. 5 is a diagram showing a temperature distribution in a heating roller of the conventional fixing device shown in FIG. 4.

FIG. 3 is a section showing the construction of an image fixing unit 147 according to a second embodiment of the present invention. With reference to FIG. 3, the image fixing unit 147 of the second embodiment has a construction different from that of the image fixing unit 47 (see FIG. 2) of the first embodiment. Specifically, the image fixing unit 147 is, as shown in FIG. 3, provided with a tubular heating roller 147*a* that produces heat by an induction heating method, a pressure roller 47*b* disposed in such a manner that can be pressed into contact with the heating roller 147*a*, and an induction heating coil 147*c* disposed outside and adjacent to the heating roller 147*a* for increasing the temperature of the heating roller 147*a*. It should be noted that the image fixing unit 147 is one example of the "fixing device" according to the present invention and the induction heating coil 147*c* is one example of the "induction coil" of the present invention.

The heating roller 147*a* has a double-layer structure comprised of a heat producing layer 147*d* made of a temperature-sensitive magnetic material (e.g. Fe—Ni alloy), and a supporting layer 147*e* disposed inside and adjacent to the heat producing layer 147*d* and made of a nonmagnetic and electrically conductive material (e.g. aluminum). It should be noted that the heat producing layer 147*d* is one example of the "first layer" according to the present invention and the supporting layer 147*e* is one example of the "second layer" according to the present invention. The heat producing layer 147*d* is so disposed as to face the induction heating coil 147*c* arranged outside and adjacent to the heating roller 147*a*. The heat producing layer 147*d* has a specified width L1 along a direction of an axis of rotation of the heating roller 147*a*, whereas the supporting layer 147*e* has a width L2 larger than the width L1 of the heat producing layer 147*d*. The width L1 of the heat producing layer 147*d* is set to be substantially equal to a passing area for sheets of the largest size used in the copier 1 (maximum sheet passing area), and is set at about 294 mm which is the passing area for A3 sheets.

PFA (tetrafluoroethylene-perfluoroalkyl vinylether copolymer) is applied to the outer surface of the heat producing layer 147*d*, thereby forming a release layer (not shown) having a function of letting a sheet easily part from the heating roller 147*a*. A supporting layer having an outer diameter of 40 mm, a thickness of 0.3 mm and made of a Fe—Ni alloy may, for example, be used as the heat producing layer 147*d* of the second embodiment. Further, a supporting layer having a thickness of 0.3 mm and made of aluminum may, for example, be used as the supporting layer 147*e* of the second embodiment. Since the heat producing layer 147*d* having a thickness of 0.3 mm and made of a Fe—Ni alloy functions to reinforce the heating roller 147*a* by being disposed in a middle part of the heating roller 147*a* with respect to longitudinal direction, the heating roller 147*a* can be sufficiently rotatably supported even if the supporting layer 147*e* having a relatively smaller thickness of 0.3 mm and made of aluminum is used.

Since it is sufficient for the induction heating coil 147*c* to be able to heat a portion of the heating roller 147*a* corresponding to at least the maximum sheet passing area L1, a width L3 of-the induction heating coil 147*c* is set at about 310 mm in the second embodiment. Thus, the width L1 (about 294 mm) of the heat producing layer 147*d* of the heating roller 147*a* is smaller than the width L3 (about 310 mm) of the induction heating coil 147*c*.

The other construction of the image fixing unit 147 according to the second embodiment is similar to that of the image fixing unit 47 according to the first embodiment.

In the second embodiment, the width L1 of the heat producing layer 147*d* made of the temperature-sensitive magnetic material is substantially equal to the maximum sheet passing area and smaller than the width L3 of the induction heating coil 147*c*. This can suppress the outward diffusion of magnetic fields generated by the induction heating coil 147*c* by being pulled by the heat producing layer 147*d* made of the temperature-sensitive magnetic material when the temperature of the heating roller 147*a* is equal to or below a Curie temperature of the temperature-sensitive magnetic material. Accordingly, the weakening of the magnetic fields supplied to the portions of the heating roller 147*a* corresponding to the vicinities of the opposite ends of the maximum sheet passing area L1 can be suppressed, which in turn enables the temperatures at these portions of the heating roller 147*a* to be easily increased. Thus, unlike a case where a temperature decrease at the portions of the heating roller 147*a* corresponding to the vicinities of the opposite ends of the maximum sheet passing area L1 is suppressed by generating stronger magnetic fields at these portions by increasing the amount of a ferrite core at portions of the heating roller 147*a* corresponding to the opposite ends of the maximum sheet passing area L1 or increasing the number of turns at portions of the induction heating coil 147*c* corresponding to the opposite ends of the maximum sheet passing area L1, the warm-up period of the device can be shortened without enlarging the parts and insufficient fixing can be suppressed.

In the second embodiment, the width L1 of the heat producing layer 147*d* made of the temperature-sensitive magnetic material is substantially equal to the maximum sheet passing area L1. Thus, the heat producing layer 147*d* made of the temperature-sensitive magnetic material is not provided at portions of the heating roller 147*a* not corresponding to the maximum sheet passing area L1. This can suppress the heating of the portions of the heating roller 147*a* not corresponding to the maximum sheet passing area L1. Since the heating efficiency of the heating roller 147*a* can be more improved, the warm-up period of the device can be more shortened and insufficient fixing can be better suppressed.

In the second embodiment, as described above, stronger magnetic fields can be supplied to the heat producing layer 147*d* made of the temperature-sensitive magnetic material by disposing the heat producing layer 147*d* of the heating roller 147*a* to face the induction heating coil 147*c* disposed outside and adjacent to the heating roller 147*a* as compared to a case where the supporting layer 147*e* made of the nonmagnetic and electrically conductive material is arranged between the heat producing layer 147*d* made of the temperature-sensitive magnetic material and the induction heating coil 147*c*. Thus, the heating efficiency of the heating roller 147*a* can be more improved.

Other effects of the second embodiment are similar to those of the first embodiment.

The embodiments disclosed in this specification should be thought not to be restrictive, but to be illustrative in every point. The scope of the present invention is defined not by the above description of the embodiments, but by claims, and all changes having meanings equivalent to claims are embraced without departing from the scope.

For example, the width of the heat producing layer made of the temperature-sensitive magnetic material is substantially equal to the passing area for the sheets of the largest size used in the copier in the foregoing embodiments. However, the present invention is not limited thereto. The width of the heat producing layer may be larger than the passing area for the sheets of the largest size used in the copier provided that it is smaller than the width of the induction heating coil.

Although the inventive fixing device is applied to the image fixing unit included in the copier as one example of the image forming apparatus in the foregoing embodiments, the present invention is not limited thereto. The inventive fixing device is also applicable to image fixing units included in printers, facsimile apparatuses or like image forming apparatuses other than copiers.

Although the Fe—Ni alloy is used as the temperature-sensitive magnetic material forming the heat producing layer and the aluminum is used as the nonmagnetic and electrically conductive material forming the supporting layer in the foregoing embodiments, the present invention is not limited thereto. A temperature-sensitive magnetic material other than the Fe—Ni alloy may be used for the heat producing layer, and a nonmagnetic and electrically conductive material other than the aluminum may be used for the supporting layer.

This application is based on Japanese Patent Application No. 2005-084061 filed on Mar. 23, 2005, the contents of which are hereby incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device for using heat to fix a toner image transferred to a sheet, the fixing device comprising:

a heating roller, a pressure roller disposed relative to the heating roller to define a contact portion therebetween for receiving the sheet, and an induction coil for increasing a temperature of the heating roller by induction heating for fixing the toner image on the sheet, wherein the heating roller includes:

a supporting layer made of a non-magnetic and electrically conductive metal material; and a heat producing layer disposed on the supporting layer and between the supporting layer and the induction coil, the heat producing layer being made of a temperature-sensitive magnetic material having a permeability that changes with temperature, the heat producing layer further having a width larger than a sheet passing area and smaller than a width defined by the induction coil along a direction of an axis of rotation of the heating roller.

2. A fixing device according to claim 1, wherein the heating roller has a tubular shape and the induction coil is arranged in the tubular heating roller.

3. A fixing device according to claim 1, wherein the heating roller has a tubular shape and the induction coil is arranged outside the tubular heating roller.

4. A fixing device according to claim 1, wherein the supporting layer is made of aluminum.

5. A fixing device according to claim 4, wherein the supporting layer is thicker than the heat producing layer.

6. A fixing device according to claim 5, wherein the supporting layer is about 3 mm thick.

7. A fixing device for fixing a toner image transferred to a front face of a sheet to the sheet by heat, comprising:

a heating roller for producing heat by an induction heating method, a pressure roller disposed in such a manner that can be pressed into contact with the heating roller, and an induction coil for increasing a temperature of the heating roller, the sheet having the toner image transferred thereto being passed through a contact portion between the heating roller and the pressure roller to have the toner image fixed thereto by the heat produced by the heating roller, wherein the heating roller includes:

a heat generating layer made of a temperature-sensitive magnetic material whose permeability changes with temperature, and a supporting layer provided adjacent to the heat generating layer and disposed so that the heat generating layer is between the supporting layer and the induction coil, the supporting layer being made of a nonmagnetic and electrically conductive metal material and being adapted to support the heat generating layer, the heat generating layer having a width larger than a sheet passing area and smaller than the width of the induction coil along a direction of an axis of rotation of the heating roller.

8. A fixing device according to claim 7, wherein the supporting layer has a width larger than that of the heat generating layer along the direction of the axis of rotation of the heating roller, and the heating roller is rotatably supported at the supporting layer.

9. A fixing device according to claim 7, wherein the heating roller has a tubular shape and the induction coil is arranged in the tubular heating roller.

10. A fixing device according to claim 7, wherein the heating roller has a tubular shape and the induction coil is arranged outside and adjacent to the tubular heating roller.

11. A fixing device according to claim 7, wherein the width of the heat generating layer along the direction of the axis of rotation of the heating roller is substantially equal to that of a maximum sheet passing area of the heating roller.

12. A fixing device according to claim 7, wherein the supporting layer is formed from aluminum.

13. A fixing device according to claim 12, wherein the supporting layer has a thickness greater than the heat generating layer.

14. An image forming apparatus, comprising:

a transferring unit for transferring a toner image to a sheet based on an image data, and an image fixing unit for fixing the toner image transferred to a front face of the sheet in the transferring unit to the sheet by heat, the image fixing unit comprising:

a heating roller for producing heat by an induction heating method, a pressure roller disposed in such a manner that can be pressed into contact with the heating roller, and an induction coil for increasing a temperature of the heating roller, the sheet having the toner image transferred thereto being passed through a contact portion between the heating roller and the pressure roller to have the toner image fixed thereto by the heat produced by the heating roller, wherein the heating roller includes:

a heat generating layer made of a temperature-sensitive magnetic material whose permeability changes with temperature, and a supporting layer provided adjacent to the heat generating layer and disposed so that the heat generating layer is between the supporting layer and the induction coil, the supporting layer being made of a nonmagnetic and electrically conductive metal material and being adapted to support the heat generating layer, the heat generating layer having a width larger than a sheet passing area and smaller than the width of the induction coil along a direction of an axis of rotation of the heating roller.

15. An image forming apparatus according to claim 14, wherein the supporting layer has a width larger than that of the heat generating layer along the direction of the axis of rotation of the heating roller, and the heating roller is rotatably supported at the supporting layer.

16. An image forming apparatus according to claim 14, wherein the heating roller has a tubular shape and the induction coil is arranged in the tubular heating roller.

17. An image forming apparatus according to claim 14, wherein the heating roller has a tubular shape and the induction coil is arranged outside and adjacent to the tubular heating roller.

18. An image forming apparatus according to claim 14, wherein the width of the heat generating layer along the direction of the axis of rotation of the heating roller is substantially equal to that of a maximum sheet passing area of the heating roller.

19. A fixing device according to claim 14, wherein the supporting layer is formed from aluminum.

20. A fixing device according to claim 19, wherein the supporting layer has a thickness greater than the heat generating layer.

* * * * *